US008969795B2

(12) United States Patent
Wollnik et al.

(10) Patent No.: US 8,969,795 B2
(45) Date of Patent: Mar. 3, 2015

(54) CURTAIN GAS FILTER FOR MASS- AND MOBILITY-ANALYZERS THAT EXCLUDES ION-SOURCE GASES AND IONS OF HIGH MOBILITY

(75) Inventors: Hermann Wollnik, Santa Fe, NM (US); Alexander Tarassov, Mars, PA (US); Gary A. Eiceman, Las Cruces, NM (US)

(73) Assignee: Shimadzu Corporation, Kyoto-shi (JP)

( * ) Notice: Subject to any disclaimer, the term of this patent is extended or adjusted under 35 U.S.C. 154(b) by 0 days.

(21) Appl. No.: 13/121,065

(22) PCT Filed: Sep. 17, 2009

(86) PCT No.: PCT/US2009/057281

§ 371 (c)(1), (2), (4) Date: Mar. 25, 2011

(87) PCT Pub. No.: WO2010/042303

PCT Pub. Date: Apr. 15, 2010

(65) Prior Publication Data

US 2011/0174966 A1 Jul. 21, 2011

Related U.S. Application Data

(60) Provisional application No. 61/103,168, filed on Oct. 6, 2008.

(51) Int. Cl.

| | |
|---|---|
| ***H01J 49/00*** | (2006.01) |
| ***H01J 49/04*** | (2006.01) |
| ***H01J 49/10*** | (2006.01) |

(52) U.S. Cl.

CPC ..... *H01J 49/0422* (2013.01); *H01J 49/10* (2013.01)

USPC ..... 250/282

(58) Field of Classification Search

USPC ..... 250/281, 282, 283, 288

See application file for complete search history.

(56) References Cited

U.S. PATENT DOCUMENTS

| | | | | |
|---|---|---|---|---|
| 4,137,750 | A * | 2/1979 | French et al. | 73/23.2 |
| 5,818,041 | A * | 10/1998 | Mordehai et al. | 250/281 |
| 5,917,184 | A | 6/1999 | Carson et al. | |
| 6,194,717 | B1 * | 2/2001 | Hager | 250/292 |

(Continued)

OTHER PUBLICATIONS

International Search Report of PCT/US2009/057281 dated Nov. 20, 2009.

(Continued)

*Primary Examiner* — Michael Logie
*Assistant Examiner* — Jason McCormack
(74) *Attorney, Agent, or Firm* — Sughrue Mion, PLLC

(57) ABSTRACT

A filter for a mass- or mobility-spectrometer that bars gases or vapors of a high-pressure ion source, as well as ions of high mobility and charged droplets, from entering an evacuated mass spectrometer or a mobility spectrometer at a lower pressure than the filter. The buffer gas of the high pressure ion source is blown into the volume of this filter directly or through tubes from where buffer gas and embedded ions are sucked through the aperture of a diaphragm or through an aperture of a capillary mainly from an "extraction volume" filled with a separately supplied clean gas, into which ions of interest are pushed by electric fields formed by electrodes that are substantially rotational symmetric around the "extraction volume" and a substantially flat electrode with respect to an axis of ion extraction and the end of the capillary and the end of a coaxial tube surrounding the capillary.

37 Claims, 6 Drawing Sheets

(56) References Cited

U.S. PATENT DOCUMENTS

| | | | | |
|---|---|---|---|---|
| 7,132,650 | B1 * | 11/2006 | Gamble et al. | 250/288 |
| 7,399,961 | B2 * | 7/2008 | Chen et al. | 250/288 |
| 7,812,305 | B2 * | 10/2010 | Miller et al. | 250/287 |
| 7,816,646 | B1 * | 10/2010 | Willoughby et al. | 250/288 |
| 7,960,711 | B1 * | 6/2011 | Sheehan et al. | 250/493.1 |
| 2001/0032930 | A1 | 10/2001 | Gillig et al. | |
| 2002/0175278 | A1 * | 11/2002 | Whitehouse | 250/281 |
| 2003/0132379 | A1 * | 7/2003 | Li | 250/286 |
| 2003/0186326 | A1 * | 10/2003 | Regnier et al. | 435/7.1 |
| 2004/0149903 | A1 | 8/2004 | Wang | |
| 2005/0109931 | A1 * | 5/2005 | Schultz et al. | 250/287 |
| 2006/0186329 | A1 | 8/2006 | Gebhardt et al. | |
| 2006/0186334 | A1 * | 8/2006 | Jolliffe et al. | 250/288 |
| 2006/0219889 | A1 * | 10/2006 | Shvartsburg et al. | 250/282 |
| 2006/0255261 | A1 * | 11/2006 | Whitehouse et al. | 250/288 |
| 2007/0284519 | A1 | 12/2007 | Rockwood et al. | |
| 2008/0073502 | A1 * | 3/2008 | Schneider et al. | 250/282 |
| 2009/0256072 | A1 * | 10/2009 | Reilly | 250/288 |

OTHER PUBLICATIONS

John B. Fenn, "Ion Formation from Charged Droplets: Roles of Geometry, Energy and Time", Journal of American Society for Mass Spectrometry, Sep. 1993, pp. 524-535, vol. 4.

Michael Karas, et al., "Laser Desorption Ionization of Proteins with Molecular Masses Exceeding 10 000 Daltons", Anal. Chem., 1988, pp. 2299-2301, vol. 60.

Min-Zong Huang, et al., "Direct Protein Detection from Biological Media Through Electrospray-Assisted Laser Desorption Ionization/Mass Spectrometry", Journal of Proteome Research, 2006, pp. 1107-1116, vol. 5.

Zoltán Takáts, et al., "Mass Spectrometry Sampling Under Ambient Conditions with Desorption Electrospray Ionization", Science, Oct. 15, 2004, pp. 471-473, vol. 306, www.sciencemag.org.

Yasuo Kousaka, et al., "Effect of Brownian Diffusion on Electrical Classification of Ultrafine Aerosol Particles in Differential Mobility Analyzer", Journal of Chemical Engineering of Japan, 1986, pp. 401-407, vol. 19, No. 5.

Beata M. Kolakowski, et al., "Review of Applications of High-Field Asymmetric Waveform Ion Mobility Spectrometry (FAIMS) and Differential Mobility Spectrometry (DMS)", The Royal Society of Chemistry, 2007, pp. 842-864, vol. 132.

Nadja B. Cech, et al., "Practical Implications of Some Recent Studies in Electrospray Ionization Fundamentals", Mass Spectrometry Reviews, 2001, pp. 362-387, vol. 20.

* cited by examiner

CURTAIN GAS FILTER FOR MASS- AND MOBILITY-ANALYZERS THAT EXCLUDES ION-SOURCE GASES AND IONS OF HIGH MOBILITY

This application claims the benefit of U.S. provisional application No. 61/103,168, filed Oct. 6, 2008, the entire disclosure of which is expressly incorporated herein by reference.

BACKGROUND OF THE INVENTION

1. Technical Field

Aspects of the present invention relate to mass spectrometers, to mobility spectrometers, and to ion sources at elevated pressures such as atmospheric-pressure sources, and more specifically, to a curtain gas filter therefor.

2. Related Art

For related art investigations of large molecules, mass spectrometers and mobility spectrometers may be used. The mass spectrometers investigate the total molecule weight, which is approximately proportional to the volume of the molecule under investigation. The mobility spectrometer investigates the speed of a charged molecule when dragged through a buffer gas, a quantity which is approximately proportional to the cross section of the molecule under investigation.

For both related art systems, the ion source is important. Commonly used ion sources for large molecules include "electrospray ion sources (ESI)" as disclosed in J. B. Fenn, JASM 4 (1993) 524 and sources for "matrix assisted laser desorbed ion sources (MALDI)" as disclosed in M. Karas, F. Hillenkamp, Anal. Chemistry 60 (1988) 2299 as well as sources for "electrospray-assisted laser desorbed ion sources (ELDI)" as disclosed in M. Z. Huang, H. J. Hsu, J. Y. Lee, J. Jeng, J. Shiea, J. Prot. Res. 5 (2006) 1107, or "desorption electrospray-ion sources (DESI)" as disclosed in Z. Takats, J. M. Wiseman, B. Gologan, G. Cooks Science 306 (2004) 471. These sources are preferentially used at elevated pressures typical at atmospheric pressure. However, other ionization methods in "atmospheric pressure ion-sources (API)" can be used as well.

Related art investigations of molecules have become important in applications related to biology, medicine and pharmacology. These related art techniques allow characterization of a molecule not only by weight and cross section but also by structure, which becomes apparent by investigating the fragments into which the molecule will break when it absorbs energy, for example, by collisions with buffer gas molecules or atoms.

SUMMARY OF THE INVENTION

Aspects of the exemplary, non-limiting embodiments include a "filter for mass- and mobility-analyzers" that bars ion-source gases and vapors as well as ions of high mobility from entering the analyzers when the ions originate in a high-pressure ion source operating for instance at atmospheric pressure. This filter may be placed at the entrance to an evacuated mass-analyzer or a mobility-analyzer that operates at a substantially lower pressure than the ion source.

Guiding the effluent of a gas- or liquid-chromatograph into an atmospheric pressure ion source (API), the total ion current consists of the ionized molecules in this effluent as well as protonated water and solvent clusters. Since these cluster ions all have very high mobilities, the proposed curtain gas filter can eliminate them efficiently so that the total ion current registered in a detector placed downstream of this filter is a direct measure of the molecule flux in the effluent of these gas or liquid chromatographs. In all cases the ions—together with a buffer gas—are sucked through the aperture of a diaphragm or of a capillary or of the apertures of a multitude of diaphragms and/or capillaries into an evacuated mass analyzer or a lower pressure mobility analyzer. However, providing the ion-source buffer gas, in which the ions of interest are embedded, to a larger volume, one finds that gas-flow forces, which push neutral and ionized molecules or atoms into the evacuated mass spectrometer or lower-pressure mobility analyzer, are only effective within a much smaller "extraction volume" directly upstream of the aperture of a diaphragm or of a capillary or upstream of the apertures of a multitude of diaphragms and/or capillaries. If this "extraction volume" is filled by a separately supplied clean curtain gas, the ion-source buffer gas as well as the embedded ions can not enter the mass- or mobility-analyzer unless the filter according to the present invention provides electric fields that inject ions of interest into this "extraction volume", with these ions being extracted from the ion-source buffer gas that surrounds the extraction volume.

The foregoing curtain gas filter according to the present invention eliminates ion-source gases and vapors of solvents. Further, the electric fields are shaped such that undesired high mobility ions, as well as undesolvated droplets, when an electro-spray ion source is used, are guided not into but around the extraction volume, thus causing these ions to not enter the mass- or mobility-analyzer.

Thus, the curtain gas filter:

1. Allows operation of a mass- or mobility analyzer with a clean buffer gas of which the temperature, humidity and purity can be controlled tightly. While retaining the ions of interest, this filter thus substantially eliminates ion-source buffer gases and vapors originating from a gas- or liquid-chromatograph, residues of solvents, or of materials of matrices into which the molecules of interest had been placed. This technique also avoids the formation of surface layers on electrodes and surfaces inside the mass- or mobility analyzers and thus allows use of buffer gases that contain nitrates or phosphates as may be used in liquid chromatographs arranged prior to the ion source.

2. Improves the use of so called "shift agents" which are used as additions to the ion-source buffer gas, where the shift agents chemically react with specific molecule ions, resulting in ions of increased or reduced mass and/or mobility. When using the curtain gas filter according to the present invention, one can add such "shift agents" to the "clean curtain gas" either constantly or during short periods only, so that the chemical reactions occur only during these periods, and the corresponding ions can only be recorded during these periods. Accordingly, the corresponding molecules can be recorded with high sensitivity.

3. Allows substantially eliminating ions of high-mobility by adjusting the shape and magnitude of electric fields in the filter so that only ions of low-mobility are pushed into the "extraction volume" but ions, whose mobilities are higher than a certain threshold, are guided around it.

3a. By comparing mass- or mobility-spectra with different elimination thresholds, one may gain additional insight into the molecule composition.

3b. Guiding the effluent of a gas- or liquid-chromatograph into an ion source and eliminating the ions of the highest mobilities, i.e. all protonated water and solvent clusters, the total ion current downstream of the curtain-gas filter of the present invention contains only ions of molecules of interest.

Monitoring this total ion current as a function of time, one thus monitors the appearance of chromatographically separated molecules.

4. In case of an "electrospray ion source (ESI)" or a source for "a droplet pickup ion source (ELDI or DESI)", charged droplets are formed that transfer their charges to incorporated molecules of interest when the liquid of the droplets evaporates. This process may be incomplete when the ions enter the capillary or the diaphragm that allows the buffer gas to enter the mass- or mobility spectrometer. However, when the ions finally are analyzed in a mass- or mobility spectrometer, the liquid of the droplets has generally fully evaporated because of elevated temperatures in the inlet device or by entering the vacuum. In the case of the exemplary "curtain-gas filter" for mass- and mobility-analyzers, mainly ions are pushed into the "extraction volume" by electric fields but no charged droplets. Thus, molecules with a low affinity to the droplet surfaces as disclosed in N. B. Cech, C. G. Enke, Mass Spectr. Rev. 20 (2001) 362, a property that relates to the solubility of the molecules under consideration, are only released at the end of the droplet evaporation process. Thus, such ions can not be recorded in a sequentially arranged mass- or mobility analyzer unless measures are taken to heat the droplets during their transport from the ion source to the extraction volume, such as the heating of surfaces in the transport canal. By keeping the temperatures of the filter low and excluding charged droplets from entering the mass- or mobility analyzer, highly soluble ions can be reduced or eliminated, while with varied temperatures of the filter, the level of reduction or elimination can be varied, thus providing additional insight into the structure of the molecules under consideration. Alternatively, a reagent may be added to a solvent of electrospray ion sources so as to change the surface affinity of the molecules of interest, and to cause ionized molecules to be released earlier than if the reagent was not added.

5. In all of the exemplary embodiments, more than one ion source can be attached and used substantially simultaneously or in close sequence.

6. According to another exemplary embodiment, an ion source blows buffer gases with embedded ions, either directly or through a mobility analyzing or focusing device into a volume of a mass- or mobility analyzer. These gases may be guided by a tube having a bore of constant or of continually reducing diameter either directly to a mass- or mobility analyzer or through a channel plate, and in some cases from there by another tube having a bore of constant or of continuously reducing diameter to a mass- or mobility analyzer. If the gas pressure upstream of the channel plate is at least a few 100 mbar higher than the gas pressure downstream of the channel plate without requiring the gas pressure downstream of the channel plate to be a vacuum pressure, the buffer gas will be sucked through the channels of the channel plate together with embedded ions substantially parallel to the axis of ion extraction in which case the ion transmission can be enhanced by applying some voltage across the channel plate. In another exemplary embodiment, the capillary is mounted directly to the tube, such that the gas pressure in the region downstream of the channel plate is only reduced by the gas flow through the capillary.

Exemplary embodiments include a spectrometry system, comprising at least one ion source that operates at an elevated pressure, at least one spectrometer, comprising at least one of a mass spectrometer and a mobility spectrometer, a curtain gas filter positioned upstream of the at least one spectrometer, the at least one spectrometer having a lower pressure than a pressure of the main volume of the filter, and a passage comprising at least one of a diaphragm and a capillary, placed between the spectrometer and the filter, through which a buffer gas including embedded ions is sucked into the at least one spectrometer. This buffer gas is sucked substantially only from an extraction volume that is substantially smaller than the main filter volume, while the buffer gas substantially other than that in the extraction volume within the main filter volume is exhausted through other openings in the filter. The main filter volume is filled by an ion-source buffer gas supplied from the at least one high-pressure ion source, and the ion-source buffer gas is replaced in the extraction volume by an externally supplied clean buffer gas wherein the clean buffer gas flows as a curtain gas into the extraction volume substantially perpendicular to an axis of ion extraction. Further, electric fields within the filter push ions of interest from the surrounding ion-source buffer gas into the curtain-gas flow of clean buffer gas and into the extraction volume filled by the clean buffer gas.

According to this embodiment, an ion attracting potential, measured relative to the potential of the passage, is applied to a filter electrode positioned at or around the passage pulling ions substantially parallel to the axis of ion extraction, and substantially into and around the extraction volume, so that ions of low mobilities having motion substantially influenced by gas-flow forces of the clean curtain gas are substantially guided into the passage, while ions of mobilities higher than a threshold mobility follow substantially lines of the electric field, pass around or through the extraction volume and are discharged at the filter electrode, so that substantially all ions having mobilities higher than the threshold mobility are eliminated. Further, at different times, the ion attracting potential is adjusted to different values so that during the different times, only ions below respective different mobility thresholds contribute to respective mass- and/or mobility spectra.

According to this embodiment, an ion repelling potential, measured relative to the potential of the passage, is applied to a filter electrode positioned around the extraction volume in which case the resulting electric field pushes the ions embedded in the ion source buffer gas substantially perpendicular towards the axis of ion extraction and into the clean gas filled extraction volume.

According to this embodiment, at least one plate or at least one grid is positioned substantially perpendicular to the axis of ion extraction and substantially outside of the extraction volume and opposite to the passage, and wherein an ion-repelling potential is applied to the at least one plate or the at least one grid relative to the potential of the passage to generate an electric field that pushes a percentage of the ions in the main filter volume into the extraction volume substantially in a direction parallel to the axis of ion extraction. Further, the at least one plate or the at least one grid has an umbrella-like or conical shape, so that there is a field component that pushes ions substantially parallel to the axis of ion extraction as well as a field component that pushes ions substantially toward the axis of ion extraction. Further, the at least one plate is positioned so that the ion-depleted ion-source gas is exhausted either through holes in the at least one plate, or around the at least one plate, or through meshes of the at least one grid.

According to this embodiment, at least one of a purity, a pressure, a temperature, and a humidity of the externally supplied clean buffer gas is controlled, kept constant or varied over time. Further, the externally supplied clean buffer gas comprises a gas that has desirable properties for the mass-spectrometer and/or the mobility spectrometer, while the ion-source buffer gas comprises a gas that has desirable properties for the at least one ion source.

Still further, to the clean buffer gas, a shift reagent may be added that reacts chemically with a specific molecule ion so that the resulting ion has a larger mass or a smaller mass or a larger mobility or a smaller mobility than the original molecule ion. Still further, the shift reagent is added intermittently for short periods, so that the molecules of larger masses or of smaller masses or of larger mobilities or of smaller mobilities appear only for short periods in the recorded spectra of the mass spectrometer and/or of the mobility spectrometer.

According to this embodiment, the mixture of the clean buffer gas replaces the ion-source buffer gas such that the ion-source buffer gas includes phosphates and/or nitrates that are capable of forming deposits on surfaces in the spectrometer.

According to this embodiment, parts of the main filter or parts of the passage comprise a tube, that transports the ion-source buffer gas of at least one electrospray ion source to the filter, is (a) heated so that the charged droplets from the electrospray ion source are fully evaporated or (b) cooled so that the charged droplets from the electrospray ion source are only partially evaporated before reaching the main volume of the filter, wherein electric fields push the released ions but not the droplets into the extraction volume so that in the recorded mass spectra and/or mobility spectra, the ions which are released at the end of the desolvation process appear in full only in case (a) while in case (b) these ions appear only with reduced intensities, providing additional information on the subject molecules. Further, a reagent is added to a solvent of at least one electro-spray ion source, wherein the reagent changes the affinity of the subject molecules to the droplet surfaces, and causes ionized ones of the subject molecules to be released at a different time from evaporating charged droplets as compared to when the reagent is not added.

According to this embodiment, the clean buffer gas is supplied (a) through at least one clean-gas guiding tube having one of a round, elliptical or polygonal cross section with a constant or tapered inner bore, the tube being arranged substantially perpendicular to or inclined with respect to the axis of ion extraction along which ions leave the extraction volume, or (b) through a space between at least two substantially parallel flat or slightly conical shaped clean-gas guiding plates arranged substantially perpendicular to the axis of ion extraction. Further, a channel plate is mounted upstream or downstream of the at least one focusing device or the at least one mobility analyzer.

According to this embodiment, the clean buffer gas is supplied (a) through a space between at least two substantially concentric clean-gas guiding tubes having one of a round, elliptical, or polygonal cross section with a constant or tapered inner bore with the axes of the tubes being arranged substantially parallel to or substantially coinciding with the axis of ion extraction or (b) through a space between the passage and an innermost one of the at least two substantially concentric clean-gas guiding tubes.

According to this embodiment, the at least one high-pressure ion source blows the ion-source buffer gas directly or through at least one of a focusing device and of a mobility analyzer into the main volume of the filter, where the main volume of the filter substantially surrounds the extraction volume. Further, the at least one high-pressure ion source blows the ion-source buffer gas into the main volume of the filter through (a) at least one ion-source buffer-gas guiding tube having one of a circular, elliptical, or polygonal cross section with a constant or tapered inner bore the tube being arranged substantially perpendicular to or inclined with respect to the axis of ion extraction, or (b) a space between at least two substantially parallel flat or slightly conical shaped ion-source buffer gas guiding plates that are arranged substantially perpendicular to the axis of ion extraction.

According to this embodiment, the at least one high-pressure ion source blows the ion-source buffer gas into the main volume of the filter through at least one ion-source buffer-gas guiding tube having one of a circular, elliptical or polygonal cross section with a constant or tapered inner bore the tube being arranged substantially parallel to the axis of ion extraction, or through a space between at least two ion-source buffer-gas guiding tubes having axes that are substantially parallel or substantially coinciding with the axis of ion extraction. Further, different constant and/or high-frequency potentials are applied to the at least two ion-source buffer gas guiding tubes, so that an electric field is established substantially perpendicular to the flow of the ion-containing ion-source buffer gas, causing ions having mobilities higher than a threshold mobility to be forced to at least one of the at least two buffer-gas guiding tubes, where the forced ions are discharged and eliminated from the ion-source buffer gas flowing into the main filter volume, and wherein the threshold mobility is controlled by the amplitude of the constant and/or high-frequency potentials. Still further, the high-frequency potential difference applied to the at least two ion-source buffer-gas guiding tubes is asymmetric such that there is a high field for a shorter time and a low field for a longer time, so that a time integral over the electric field during high-field periods differs from a time integral over the electric field during low-field periods, so that only ions can pass that have high-field mobilities that differ from their low-field mobilities by substantially the same percentage as the time integrals over the corresponding field periods, wherein during certain periods a constant potential difference is added so that during the respective periods ions can pass whose high-field and low-field mobilities have respective different ratios.

According to this embodiment the threshold mobility is adjusted by varying the magnitude of the mentioned high frequency field between the two substantially coaxial ion source gas guiding tubes, or the magnitude of the ion attracting potential applied to the mentioned tube placed around the passage, or the magnitude of the ion repelling potential of the mentioned at least one plate or at least one grid placed substantially perpendicular to the axis of ion extraction on the relative to the passage opposite side of the extraction volume. In this way this threshold mobility may be adjusted so that substantially only ions of high mobility formed from protonated clusters of water and solvent molecules are substantially eliminated. In this case only molecule ions of interest remain in the extraction volume and the total ion current downstream of the curtain gas filter monitors the content of molecule ions in the ion-source buffer gas, thus monitoring the content of molecules in the effluent of a gas- or liquid-chromatograph as a function of time. Entering these ions of interest downstream of the curtain-gas filter into a mass- or mobility spectrometer one may also avoid saturation effects in these spectrometers.

According to this embodiment, the curtain gas filter is mounted within a tube that is detachably attached to the passage, such that the filter is a replaceable physical prolongation of the passage.

According to this embodiment, at the entrance to the passage an arrangement of ring electrodes is positioned, the ring electrodes having axes substantially coinciding with the axis of ion extraction and having shapes and potentials such that the potential distribution approximates that of an ion attracting point charge located close to the entrance of the passage situated within the extraction volume from where the ions are sucked into the passage. Further, the ring electrodes comprise at least one tubular ring electrode with an axis that substantially coincides with the axis of ion extraction and/or at least one flat ring electrode whose plane is substantially perpendicular to and having an axis substantially coinciding with the axis of ion extraction, wherein the flat ring electrode is configured as a printed circuit board. Still further, the entrance to the passage comprises a skimmer having a top that protrudes slightly through the at least one flat ring electrode. Still further, the at least one tubular ring electrode and/or the at least one flat ring electrode is divided in azimuthal sections, to which different potentials are applied to generate multipole-fields including dipole-fields superimposed over the rotationally symmetric electric field.

According to this embodiment, the passage comprises either only at least one diaphragm as a single unit or at least one diaphragm mounted upstream and/or downstream of a capillary, wherein an inner diameter of the at least one diaphragm may vary along the axis of ion extraction, so that the inner diameter decreases or that the inner diameter first decreases and then increases. Further, the diaphragm comprises insulating material or a material of high-resistivity, and (a) comprises an inner surface coated by a conductive material through which a current is passed which is substantially parallel to the axis of ion extraction or (b) comprises conductive parts through which a current is passed that is substantially parallel to the axis of ion extraction, so that in case (a) and case (b), an electric field is formed that assists the motion of ions through the diaphragm.

According to this embodiment, the passage further comprises at least one channel plate, having channels through which ions are forced by gas-flow forces when the channel plate is mounted such that a pressure difference is established across the channel plate either by increasing a gas pressure upstream of the at least one channel plate and/or by reducing a gas pressure downstream of the at least one channel plate, wherein the gas pressure downstream of the at least one channel plate may be several percent of one atmosphere. Further, a potential difference is applied across the at least one channel plate, to establish electric fields that assist ion motion through the channels.

According to this embodiment, at least one channel plate is mounted upstream and/or downstream of at least one of the at least one mobility spectrometer, wherein the gas pressure downstream of the at least one channel plate can be several percent of one atmosphere.

According to another exemplary embodiment, a spectrometry system comprises at least one ion source that operates at an elevated pressure, at least one spectrometer comprising at least one of a mass spectrometer and a mobility spectrometer, and a passage comprising at least one of a diaphragm and a capillary, placed between the at least one spectrometer and the at least one ion source, through which a percentage of the ion-source buffer gas including embedded ions is sucked into the at least one spectrometer through (a) a passage comprising a capillary, or a shaped diaphragm, or (b) a shaped diaphragm positioned upstream and/or downstream of the capillary—; and wherein an arrangement of ring electrodes is positioned upstream of the passage with the axes of the ring electrodes substantially coinciding with the axis of ion extraction and having shapes and potentials such that an achieved potential distribution approximates that of an ion attracting point charge situated within the extraction volume, from where the ions are sucked into the passage.

According to this embodiment, the ring electrodes comprise at least one tubular ring electrode having an axis that substantially coincides with the axis of ion extraction and/or at least one flat ring electrode whose plane is substantially perpendicular to and having an axis substantially coinciding with the axis of ion extraction, wherein the flat ring electrode is configured as a printed circuit board. Further, the entrance to the passage comprises a skimmer having a top that protrudes slightly through the at least one flat ring electrode. Further, at least one of the at least one tubular ring electrode and/or of the at least one flat ring electrode is divided in azimuthal sections to which different potentials are applied to generate multipole-fields including dipole-fields superimposed over the rotationally symmetric electric field.

According to this embodiment, the passage comprises either only at least one diaphragm or at least one diaphragm mounted upstream and/or downstream of the at least one capillary, and wherein the inner diameter of the diaphragm varies along the axis of ion extraction, so that the inner diameter decreases or first decreases and then increases. Further, the diaphragm comprises an insulating material or a material of high-resistivity, and (a) includes an inner surface coated by a conductive material through which a current is passed which is substantially parallel to the axis of ion extraction or (b) includes conductive parts through which a current is passed that is substantially parallel to the axis of ion extraction to generate an electric field that assists the motion of ions through the diaphragm.

According to this embodiment, at least one channel plate is placed within the passage, as well as upstream and\or downstream of the mobility spectrometer or the focusing device. These channel plates have channels through which ions are forced by gas-flow forces when the channel plate is mounted such that a pressure difference is established across the channel plate either by increasing a gas pressure upstream of the at least one channel plate or by reducing a gas pressure downstream of the at least one channel plate wherein the gas pressure downstream of said channel plate may be several percent of one atmosphere. Further, a potential difference is applied across the at least one channel plate to establish electric fields that assist ion motion through the channels.

BRIEF DESCRIPTION OF THE DRAWINGS

The above and/or other aspects and features will become apparent and more readily appreciated from the following description of the exemplary embodiments, taken in conjunction with the accompanying drawings, in which.

DETAILED DESCRIPTION OF THE INVENTION

Figure 1:
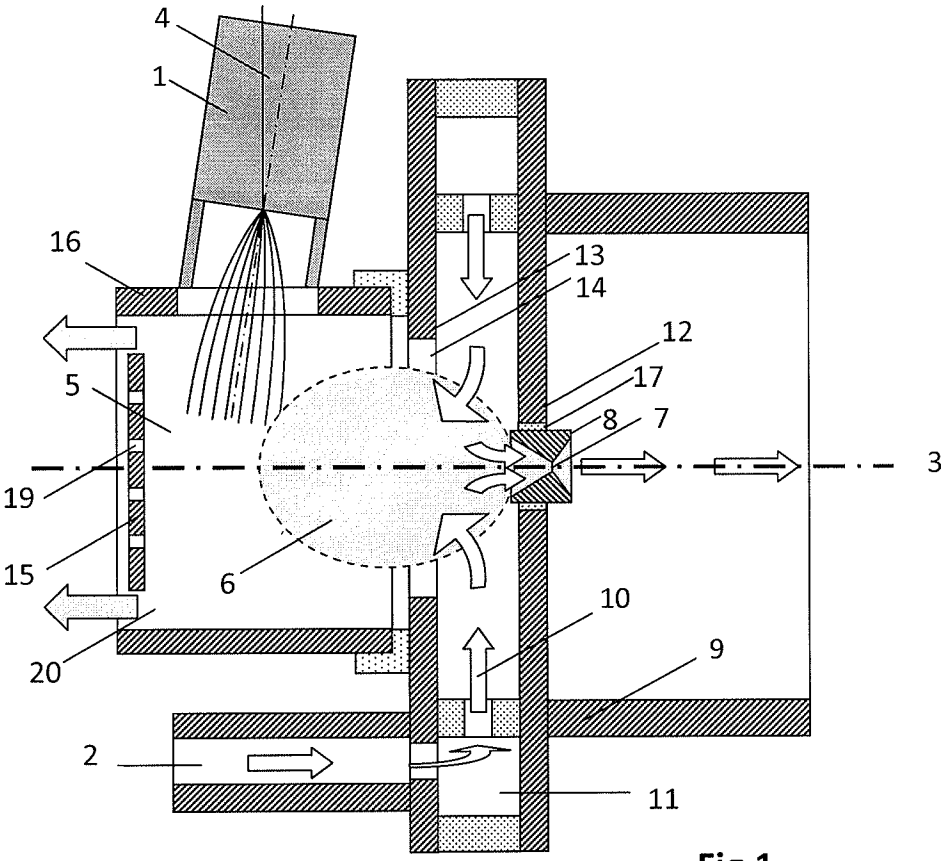
FIG. 1 is a schematic view of a first exemplary, non-limiting embodiment of a "filter for mass- and mobility-analyzers" that substantially eliminates contamination gases and molecules of high mobility.

Exemplary embodiments will be described in greater detail with reference to the accompanying drawings. In the following description, the same drawing reference numerals are used for the same elements in all drawings. The matters defined in the description such as a detailed construction and arrangement of elements are only those provided to assist in a comprehensive understanding of the invention. Thus, it is apparent that the present invention can be carried out without being limited to those defined matters. Also, well-known functions or constructions are not described in detail since they would obscure the invention in unnecessary detail.

FIG. 1 is a schematic view of a first exemplary, non-limiting embodiment of a "filter for mass- and mobility-analyzers" that substantially eliminates ion-source gases and vapors as well as molecules of high mobilities. Except for the ion source 1 and the clean-gas inlet 2, this exemplary embodiment includes substantially rotational parts arranged around the "axis of ion extraction" 3.

The ion source 1 blows its buffer gas, which may contain undesired vapors, together with the embedded ions at an angle 4 either directly or through a tube (not shown) into a main filter volume 5. However, only from a much smaller "extraction volume" 6—prior to a passage, such as an aperture 7 of a diaphragm 8—neutral or ionized molecules or atoms are effectively sucked into the vessel 9 of a spectrometer, such as an evacuated mass spectrometer or a mobility analyzer, that operates at a pressure that is lower than that of the "extraction volume" 6. The filter is upstream of the spectrometer, with a passage therebetween.

In the exemplary embodiment shown in FIG. 1, this "extraction volume" 6 is filled by a clean buffer gas 10 that is externally supplied through the inlet 2 into a ring canal 11, and from there through the space between a diaphragm holding plate 12 and a thereto substantially parallel plate 13, that has a wide aperture 14 and is mounted and insulated by the ring canal 11.

The ions of interest, which so far exist only in the main filter volume 5 surrounding the "extraction volume" 6, are pushed by electric fields into the "extraction volume" 6. These electric fields have a longitudinal field component that pushes the ions towards the aperture 7 of the diaphragm 8 substantially parallel to the "axis of ion extraction" 3. This field component is mainly formed by applying to a plate or grid 15 an ion-repelling potential measured relative to the potentials of the plates 12 and 13. There is also a radial field component that pushes the ions towards the "axis of ion extraction" 3. This radial field component is mainly formed by applying to a ring electrode 16 an ion-repelling potential measured relative to the potentials of the plates 13 and 12 as well as of the diaphragm 8 mounted by an insulator 17 onto plate 12, which in the exemplary embodiment of FIG. 1 is shown to be part of the spectrometer vessel 9. The corresponding electric fields push a majority of all ions into the extraction volume 6, so that they can be sucked through the passage, e.g. the aperture 7 of the diaphragm 8. Ions of very high mobilities, however, are pulled directly to the diaphragm 8 or the plate 12, where they are annealed. By changing the potentials of the diaphragm 8 and/or the plate 12, the "cutoff threshold" of high-mobility ions can be shifted.

When a percentage of the ions contained in the ion-source buffer gas in the main filter volume 5 have been pushed into the "extraction volume" 6, the ion-depleted ion-source buffer gas is exhausted through holes 19 in the plate 15 or through openings 20 around this plate or—in case the plate 15 is formed as a grid—through the meshes of this grid.

In the exemplary embodiment of FIG. 1, the diaphragm 8 is shown as being formed so that the opening in the diaphragm decreases towards the aperture 7 and increases thereafter (e.g., resembling a Laval nozzle), which causes the gas flow to increase up to the aperture and to decrease thereafter. However, different forms of the diaphragm are exemplary alternatives.

The diaphragm 8 may be an insulator with very high resistivity, and include an inner surface coated with a conductive material, so that current is passed substantially parallel to the axis of ion extraction. Thus, an electric field is formed through the diaphragm 8, causing a field that forces the ions through the diaphragm 8. Alternatively, the diaphragm 8 may include a resistive material through which a current is passed substantially parallel to the axis of ion extraction, causing a field that forces the ion through the diaphragm 8.

Figure 2:
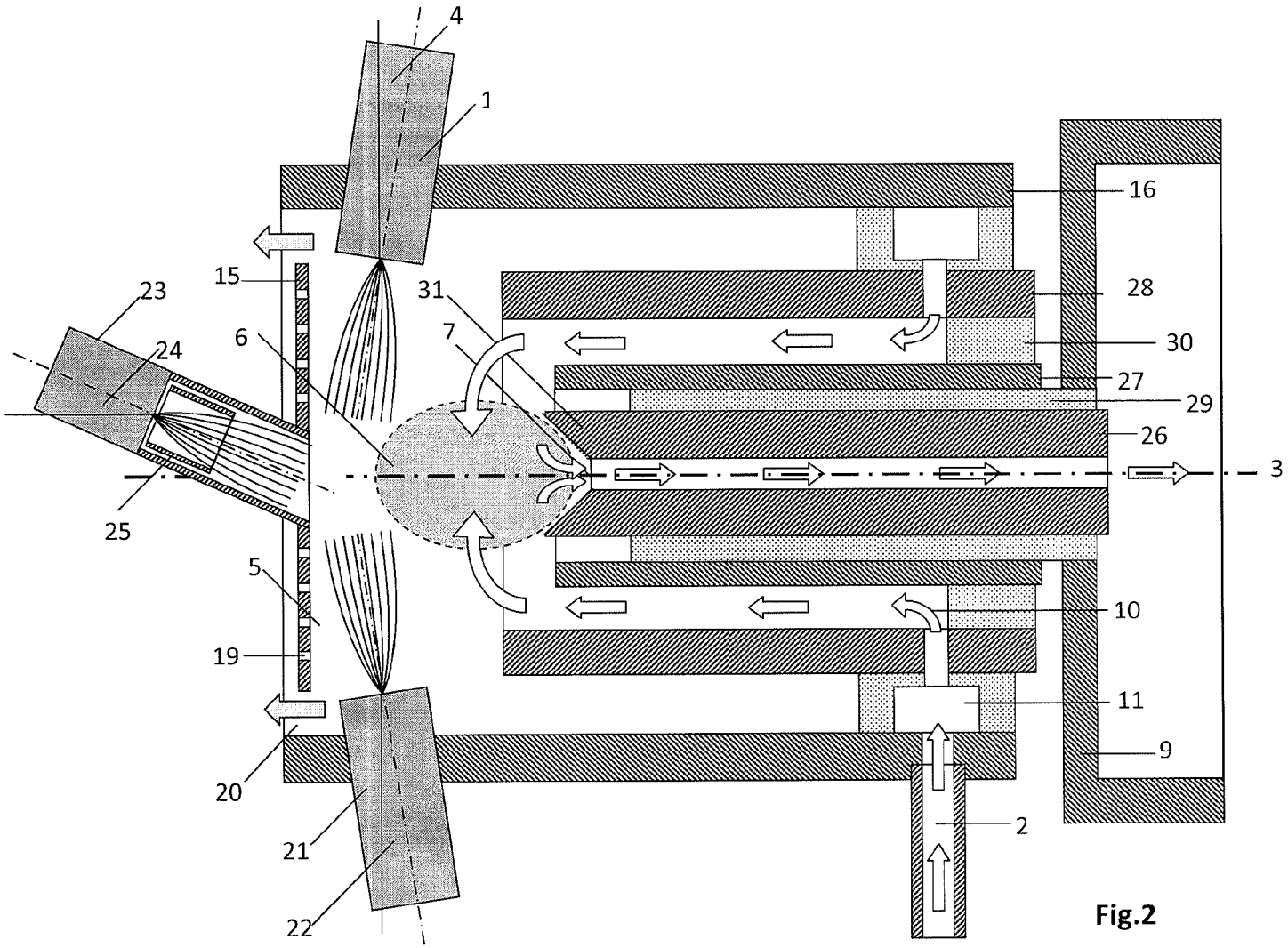
FIG. 2 is a schematic view of a second exemplary, non-limiting embodiment of a "filter for mass- and mobility-analyzers" that substantially eliminates contamination gases and molecules of high mobility.

FIG. 2 is a schematic view of a second exemplary, non-limiting embodiment of a "filter for mass- and mobility-analyzers" that substantially eliminates ion-source gases and vapors as well as molecules of high mobilities. Except for the three ion sources 1, 21 and 23 and the clean-gas inlet 2, this exemplary embodiment includes substantially rotational parts arranged around the "axis of ion extraction" 3.

The ion sources 1, 21, and 23 blow their buffer gases, which may contain undesired vapors, together with the embedded ions at angles 4, 22 and 24, which for example but not by way of limitation, may all be zero, either directly or through some mobility analyzing or focusing device 25 or through a tube (not shown) into the main filter volume 5. However, only from a much smaller "extraction volume" 6 adjacent to the aperture of a capillary 26—neutral or ionized molecules or atoms are effectively sucked into the vessel 9 of a spectrometer, such as an evacuated mass spectrometer or a mobility analyzer that operates at a pressure that is lower than that of the "extraction volume" 6.

In the exemplary embodiment shown in FIG. 2, this "extraction volume" 6 is filled by a clean buffer gas 10 that is externally supplied through the inlet 2 into a ring canal 11 and from there, through the space between two substantially concentric tubes 27 and 28 (i.e., clean gas guiding tubes). For these two tubes to be at different adjustable potentials, they are held in place by insulators 29 and 30.

The ions of interest, which initially exist only in the main filter volume 5 surrounding the "extraction volume" 6, are pushed by electric fields into the "extraction volume" 6. These electric fields have a longitudinal field component that pushes the ions towards the aperture 7 of the capillary 26 substantially parallel to the "axis of ion extraction" 3. This field component is substantially formed by applying to a plate or grid 15 an ion-repelling potential and to the tube 27 an ion-attracting potential both measured relative to the potential of the capillary 26.

There is also a radial field component that pushes the ions towards the "axis of ion extraction" 3. This field component is substantially formed by applying ion-repelling potentials measured relative to the potential of the capillary 26 to the tube 28 and to a ring electrode 16, which is mounted and insulated from the tube 28 by the ring canal 11. The corresponding electric fields will push the majority of all ions into the "extraction volume" 6 so that they can be sucked through the aperture 7 of the capillary 26 and the capillary itself. Ions of very high mobilities, however, are pulled directly to the tube 27 and to some percentage to the wall of the capillary 26, where they are annealed. By changing the potential of the tube 27, the "cutoff threshold" of high-mobility ions can be shifted. When a percentage of the ions contained in the ion-source buffer gas in the main filter volume 5 has been pushed into the "extraction volume" 6, the ion-depleted ion-source buffer gas is exhausted through holes 19 in the plate 15 or through openings 20 around it or—in case the plate 15 is formed as a grid—through the meshes of this grid. In the exemplary embodiment of FIG. 2, the entrance to the capillary 26 is shown to not be cut off perpendicular to the "axis of ion extraction", but ending in a cone with a substantially $\leq\pi/2$ cone angle 31. In the exemplary embodiment of FIG. 2, an insulator 29 mounts the capillary 26 to the spectrometer vessel 9 so that the capillary 26 can be at a different potential than the vessel 9

Figure 3:
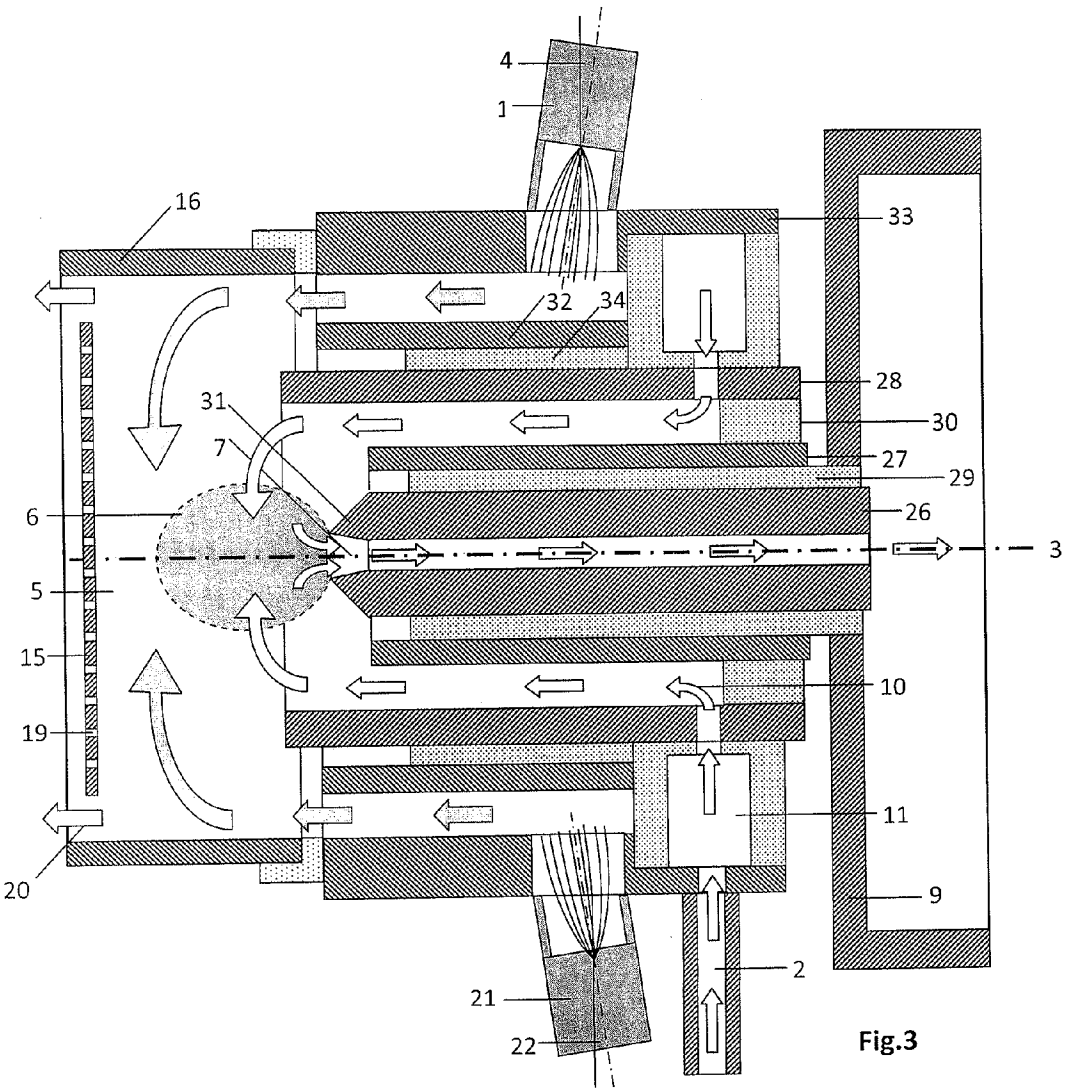
FIG. 3 is a schematic view of a third exemplary, non-limiting embodiment of a "filter for mass- and mobility-analyzers" that substantially eliminates contamination gases and molecules of high mobility.

FIG. 3 is a schematic view of a third exemplary, non-limiting embodiment of a "filter for mass- and mobility-analyzers" that substantially eliminates ion-source gases and vapors as well as molecules of high mobilities. Except for the shown two ion sources 1 and 21 and the clean-gas inlet 2, this exemplary embodiment includes substantially rotational parts arranged around the "axis of ion extraction" 3.

The ion sources 1 and 21 blow their buffer gas, which may contain undesired vapors, together with the embedded ions at angles 4 and 22, which for example but not by way of limitation, may all be zero, into the space between two substantially concentric tubes 32 and 33 (i.e. buffer-gas guiding tubes), and from there into the main filter volume 5. However, only from a much smaller "extraction volume" 6—directly before the aperture 7 of a capillary 26—neutral or ionized molecules or atoms are effectively sucked into the vessel 9 of an evacuated mass spectrometer or of a mobility analyzer operating at a pressure that is lower than that of the "extraction volume" 6.

In the exemplary embodiment shown in FIG. 3, this "extraction volume" 6 is filled by a clean buffer gas 10 that is externally supplied through the inlet 2 into a ring canal 11, and from there through the space between two substantially concentric tubes 27 and 28 (i.e. clean gas guiding tubes). For these two tubes to be at different adjustable potentials, they are held in place by insulators 29 and 30.

The ions of interest, which initially exist only in the main filter volume 5 surrounding the "extraction volume" 6, are then pushed by electric fields into the "extraction volume" 6.

These electric fields have a longitudinal field component that pushes the ions towards the aperture 7 of the capillary 26 substantially parallel to the "axis of ion extraction" 3. This field component is mainly formed by applying to a plate or grid 15 an ion-repelling potential, and to the tube 27 an ion-attracting potential, both of which are measured relative to the potential of the capillary 26. There is also a radial field component that pushes the ions towards the "axis of ion extraction" 3. This radial field component is substantially formed by applying to the tube 28 and the ring electrode 16 ion-repelling potentials both of which are measured relative to the potential of the capillary 26.

The corresponding electric fields will push the majority of all ions into the "extraction volume" 6 so that they can be sucked through the aperture 7 of the capillary 26. Ions of very high mobilities, however, are pulled directly to the tube 27 and a percentage of the ions are pulled to the capillary 26, where they are annealed. By changing the potential of the tube 27, the "cutoff threshold" of high-mobility ions can be shifted.

When a percentage of the ions contained in the ion-source buffer gas in the main filter volume 5 has been pushed into the "extraction volume" 6, the ion-depleted ion-source buffer gas is exhausted through holes in the plate 15 or through openings 20 around it or—in case the plate 15 is formed as a grid—through the meshes of this grid.

In the exemplary embodiment shown in FIG. 3, the entrance to the capillary 26 is shown to not be cut off perpendicular to the "axis of ion extraction", as may be done, but instead ends in a double cone 31, with both cone angles being substantially $\leq\pi/2$. The capillary 26 and the vessel 9 can be at different potentials since they are connected by an insulator 29.

In the exemplary embodiment shown in FIG. 3, ions of high mobilities can be eliminated not only by pulling them to the electrode 27, but also by applying a constant or a varying potential difference between the tubes 32 and 33 which are insulated from each other by the ring canal 11 and from the other electrodes of the filter by the insulator 34. The resulting radial electric field and the longitudinal gas flow then can act as a "differential mobility analyzer (DMA)" as disclosed in E. O. Knutson, K. T. Whitby, J. Aerosol Science 6 (1975) 443, which is herein incorporated by reference, in which ions of high mobilities reach the tube walls where they are annealed. By varying this potential difference, one can also shift the "cutoff threshold" of high-mobility ions. Adding an asymmetric high-frequency voltage, one can create a situation as in a "differential mobility spectrometer (DMS)" as disclosed in B. M. Kolakowski, Z. Mester, Analyst 132 (2007) 842, and in H. Wollnik, G. A. Eiceman and D. Papanastasiou, patent application Ser. No. 11/812,886, published as U.S. Patent Application Publication No. 2006-0315087-A1, which is herein incorporated by reference, in which the nonlinear dependence of the mobility of ions on a deflecting voltage is used to allow only ions to pass for which the ratio of their high-voltage mobility, and their low-voltage mobility has a determined value.

The mounting and insulation of the plate or grid 15 are not shown in detail in FIGS. 1-3. The plate or grid 15 is shown in FIGS. 1-3 as being flat, though it may be bulged in an umbrella-like manner, so that there is not only a field component parallel to the axis of ion extraction 3, but also a component substantially perpendicular to this axis. The mounting and insulation of the plate or grid 15 would have a structure as understood by one of ordinary skill in the art.

In the exemplary embodiments of FIGS. 1-3, high-mobility ions of protonated water clusters and protonated solvent molecules may be substantially eliminated, so that only ions of interest are left in the "extraction volume" 6. This allows using the filter according to the exemplary embodiments as a monitor of the effluent of a gas—or liquid chromatograph as a function of time, if an ion detector (not shown) is placed in the spectrometer vessel 9 downstream of the diaphragm 7 in FIG. 1, or downstream of the capillary 26 in FIGS. 2-3.

Figure 4:
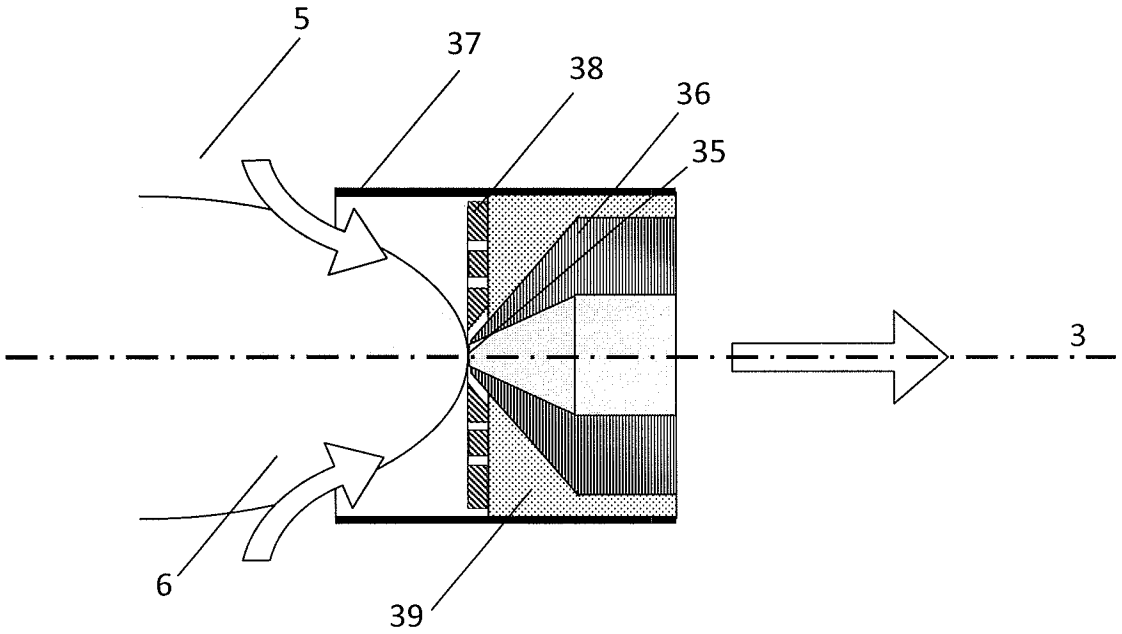
FIG. 4 is a schematic view of an exemplary, non-limiting embodiment of an addition to the "filter for mass- and mobility-analyzers" that substantially eliminates ion-source gases and vapors as well as molecules of high mobilities, as illustrated by the exemplary embodiments shown in FIGS. 1-3.

To such a "filter for mass- and mobility-analyzers" that eliminates ion-source gases and vapors as well as molecules of high mobilities, as is illustrated by the exemplary embodiments shown in FIGS. 1-3, an "ion concentrator" as shown in FIG. 4 can be mounted that may affect the overall ion transmission. Such an "ion concentrator" is small in terms of its dimensions relative to the size of other parts of the filter, and could be placed closely before or around the diaphragm 8 as shown in FIG. 1, or at the entrance of the capillary 26 as shown in FIGS. 2-3.

This exemplary embodiment of an ion concentrator shown in FIG. 4 may consist of a skimmer 36 with an entrance aperture 35, as well as at least one tube-like ring electrode 37 and at least one additional ring electrode 38 that can be formed as at least one printed circuit board, where all the ring electrodes are mounted on an insulator 39. All parts of this ion concentrator are shown in FIG. 4 as being substantially rotational with respect to the "axis of ion extraction" 3 though square or rectangular arrangements would be feasible as well. To the different concentrator electrodes, different potentials should be applied that substantially push ions towards a point in the "extraction volume" 6 right above the entrance aperture 35 of the skimmer 36. The ring electrodes 37 and 38 can also be divided azimuthally so that by applying appropriate potentials to the different segments multipole fields can be formed, including dipole fields that can correct misalignments of the ion concentrator and the filter shown in FIGS. 1-3. While the foregoing exemplary embodiments of an "ion concentrator" include the disclosure of a filter, it should be noted that one skilled in the art at the time of the invention would understand that without departing from the scope of the present invention such an "ion concentrator" may also be applied to a system in which ions are fed directly from an electrospray ion source or some other atmospheric pressure source to a mass- or mobility spectrometer that operates at a lower pressures than the ion source. In such a system, the ion concentrator would be placed between the ion source and the passage to the mass- or mobility spectrometer. Exemplary embodiments of such filter-free "ion concentrators" are shown in FIGS. 5-6.

Figure 5:
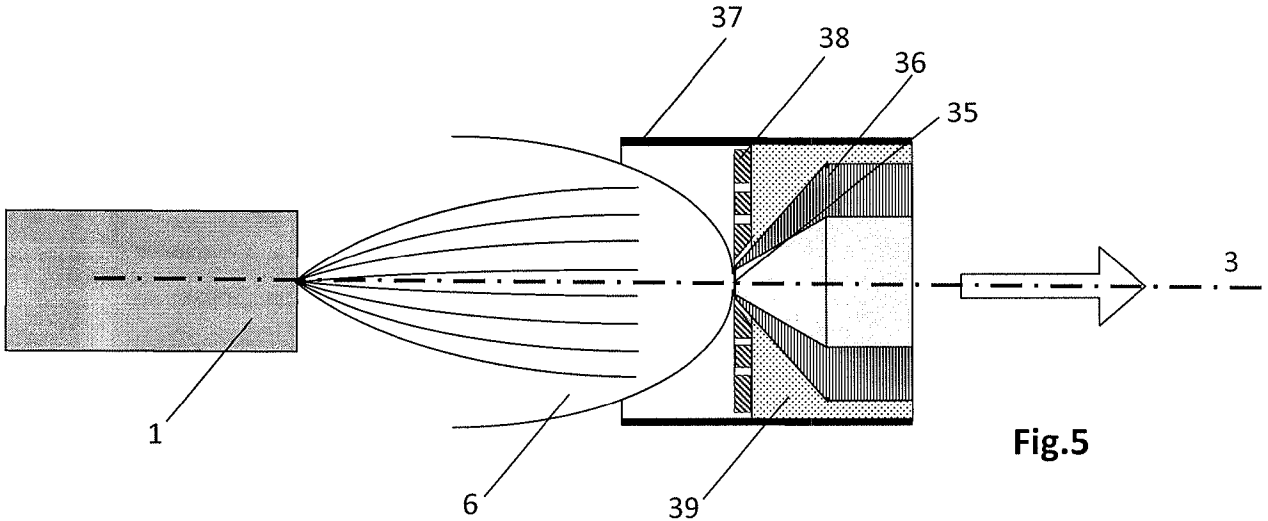
FIG. 5 illustrates a filter-free ion concentrator system wherein the ion concentrator is placed between the ion source and the passage to the mass- or mobility spectrometer, according to a first exemplary, non-limiting embodiment.

A first exemplary embodiment of such a filter-free "ion concentrator" shown in FIG. 5 includes a skimmer 36 with an entrance aperture 35, as well as at least one tube-like ring electrode 37 and at least one additional ring electrode 38 that can be formed as at least one printed circuit board; all the ring electrodes are mounted on an insulator 39.

Figure 6:
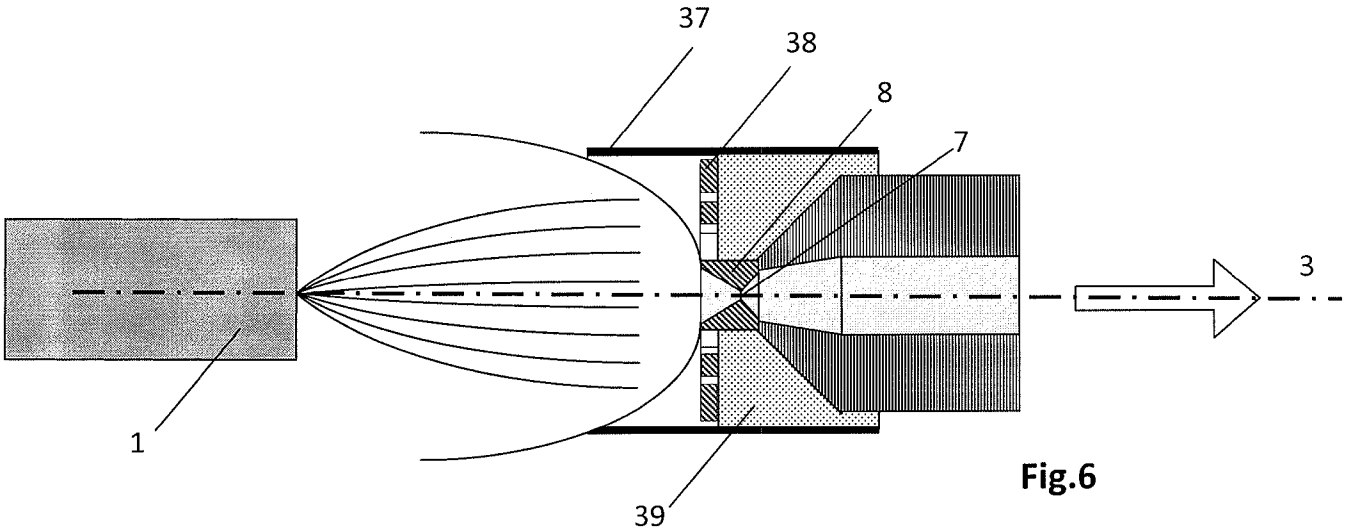
FIG. 6 illustrates a filter-free ion concentrator system wherein the ion concentrator is placed between the ion source and the passage to the mass- or mobility spectrometer, according to a second exemplary, non-limiting embodiment.

A second exemplary embodiment of such a filter-free "ion concentrator" shown in FIG. 6 includes a diaphragm 8 with an aperture 7 similar to the one shown in FIG. 1. Though different forms of such a diaphragm are feasible, the exemplary embodiment of the "ion concentrator" in FIG. 6 is formed so that the opening of the diaphragm 8 decreases towards the aperture 7 and increases thereafter (e.g., resembling a Laval nozzle), which causes the gas flow to smoothly increase up to the aperture and to decrease thereafter. In such a diaphragm the ion transmission can be affected by building the diaphragm 8 from substantially insulating material and coating its inner surface with a conductive layer and or include resistive materials in the volume of the diaphragm. Passing through this conductive layer or the included resistive parts an electric current which is substantially parallel to the "axis of ion extraction" 3, an electric field can be formed that assists the ion motion through the diaphragm 8. Also in this exemplary embodiment of a filter-free "ion concentrator", at least one tubular ring electrode 37 is shown, and at least one additional ring electrode 38, which can be formed as at least one printed circuit board mounted on an insulator 39.

All parts of the ion concentrators of FIGS. 5-6 are shown to be substantially rotational with respect to the "axis of ion extraction" 3 though square or rectangular arrangements would be feasible as well. In the exemplary embodiments shown in FIGS. 5-6, to the different concentrator electrodes, different potentials can be applied that substantially push ions towards a point in the "extraction volume" 6 right above the entrance aperture 35 of the skimmer 36 or the diaphragm 8. The ring electrodes 37 and 38 shown in FIG. 5 and in FIG. 6 can also be divided azimuthally so that multipole fields can be formed, including dipole fields that can correct misalignments of the ion concentrator and the ion source 1.

All parts of this ion concentrator are shown as being substantially rotational with respect to the "axis of ion extraction" 3 though substantially square or rectangular arrangements would be feasible as well. To the different concentrator electrodes, different potentials may be applied that push the ions substantially towards a point right above the aperture 7 in FIG. 5. The ring electrodes 37 and 38 can also be divided azimuthally so that multipole fields can be formed, including dipole fields that can correct misalignments of the filter parts.

For example, a spectrometer having a diaphragm or capillary inlet system that is used to couple atmospheric pressure ion sources to a vacuum or low pressure system may include various of the foregoing aspects and features, including, but not limited to, the ring electrode, including electrodes on a printed circuit board or a conductive surface, or having azimuthal sections of dipole fields; diaphragm shape, material, electrical flow or diameter; and using of guiding tubes to introduce the buffer gas.

Figure 7:
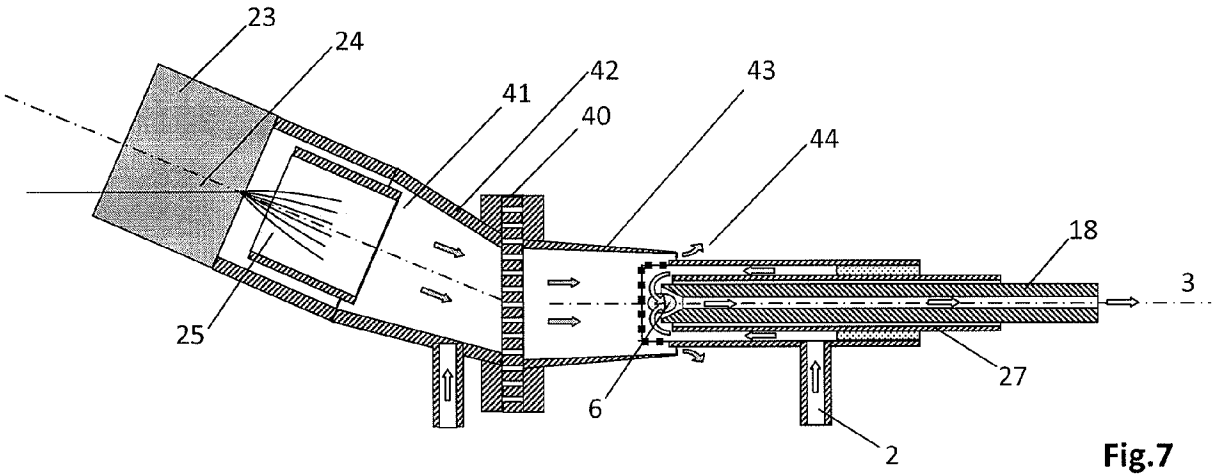
FIG. 7 illustrates a filter-free ion passage wherein according to another exemplary, non-limiting embodiment, the ion source buffer gas is sucked through a capillary after it has been sucked through the channels of a channel plate in which the passage of ions is assisted by a voltage applied across the channel plate.
Figure 8:
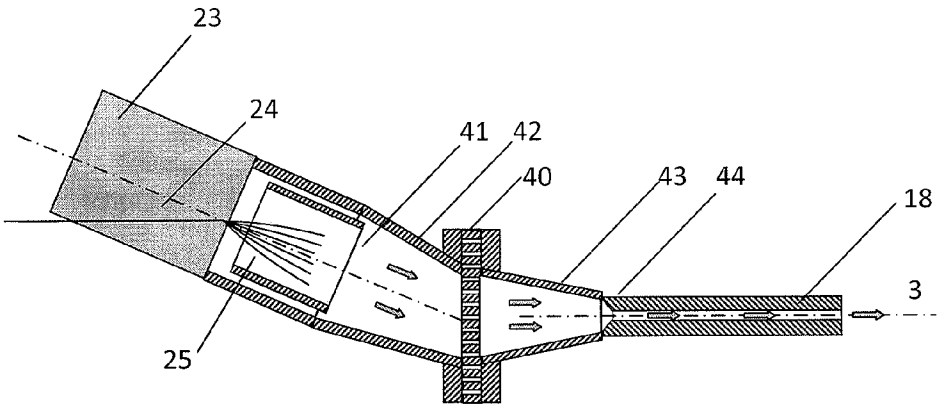
FIG. 8 is a schematic view of another exemplary, non-limiting embodiment of a "filter for mass- and mobility-analyzers" that substantially eliminates contamination gases and molecules of high mobility; wherein the ion source buffer gas—prior to being entered into this filter—is sucked through the channels of a channel plate in which the passage of ions is assisted by a voltage applied across the channel plate.

In FIGS. 7-8, schematic views illustrate ion-source buffer gases being guided from an ion source 23 through the capillary 18 to a mass- or mobility-spectrometer (not shown) that is operated at a lower pressure than the ion source 23. The efficiency of transmission may be improved by use of a channel plate 40 placed downstream of a mobility analyzer 25. In this case, the ions experience not only gas-flow forces when guided with the buffer gas through the channels of this channel plate, but also electric field forces when a voltage is applied across the channel plate.

In FIG. 7 and FIG. 8, an ion source 23 blows buffer gases, which may contain undesired vapors, together with the embedded ions at an angle 24, which for example but not by way of limitation, may be zero, either directly or through a mobility analyzing or focusing device 25 into the volume 41. These gases may be guided by a tube 42—having a bore of continually reducing diameter—to the channel plate 40, and from there by another tube 43 also having a bore of continuously reducing diameter. Ensuring that the gas pressure upstream of the channel plate 40 is higher than the gas pressure downstream of the channel plate 40, the buffer gas will be sucked through the channels of the channel plate 40 together with embedded ions substantially parallel to the axis of ions extraction 3. This can be achieved by either operating the ion source at a sufficiently elevated pressure, or by partially evacuating the region downstream of the channel plate 40.

In the exemplary embodiment shown in FIG. 7, the capillary 18 is part of a curtain-gas filter as disclosed with respect to the curtain-gas filters shown in FIGS. 2-3, in which a clean buffer gas is provided through a guiding tube 2 and a ring canal 11, with this clean gas replacing the ion-source buffer gas in the extraction volume 6 directly upstream of the entrance to the capillary 18. In this case, the ions must be forced into this extraction volume 6 from the surrounding ion-source buffer gas by an electric field formed by applying an ion attracting potential to the tube 27 whose axis is substantially parallel to the axis of ions extraction 3, as is the axis of the capillary 18. The gas pressure is reduced in the region downstream of the channel plate partially by the gas flow through the capillary 18 and partially through the gas flow through the exhaust 44, through which the ion-source buffer gas is exhausted when a percentage of the ions has been extracted.

In the exemplary embodiment shown in FIG. 8, the capillary 18 is mounted directly to the tube 43. The gas pressure in the region downstream of the channel plate is only reduced by the gas flow through the capillary, in case the capillary is tightly connected to the tube 43 as illustrated in FIG. 8.

The forgoing embodiments are merely exemplary and are not to be construed as limiting. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A spectrometry system, comprising:

at least one ion source that operates at an elevated pressure;

at least one spectrometer, comprising at least one of a mass spectrometer and a mobility spectrometer;

a curtain gas filter positioned upstream of said at least one spectrometer, said at least one spectrometer having a lower pressure than a pressure of a main volume of said filter; and a passage comprising at least one of a diaphragm and a capillary, placed between said spectrometer and said filter, through which a buffer gas including embedded ions is sucked into said at least one spectrometer, said buffer gas being sucked substantially only from an extraction volume that is substantially smaller than the main filter volume, while the buffer gas substantially other than that in said extraction volume within said main filter volume is exhausted through other openings in the filter, a filter electrode surrounding the at least one of a diaphragm and a capillary;

wherein said main filter volume is filled by an ion-source buffer gas supplied from said at least one high-pressure ion source, and wherein said ion-source buffer gas is replaced in said extraction volume by an externally supplied clean buffer gas, and wherein electric fields within the filter push ions of interest from the surrounding ion-source buffer gas into said extraction volume filled by said clean buffer gas, and wherein an ion attracting potential, measured relative to the potential of the passage, is applied to the filter electrode that pulls ions substantially parallel to an axis of ion extraction, and substantially into and around the extraction volume, so that ions of low mobilities having motion substantially influenced by gas-flow forces of said clean curtain gas are substantially guided into said passage, while ions of mobilities higher than a threshold mobility follow substantially lines of the electric field, pass around or through the extraction volume and are attracted to and discharged by said filter electrode, so that substantially all ions having mobilities higher than said threshold mobility are eliminated.

2. The spectrometry system of claim 1, wherein the clean buffer gas flows as a curtain gas into said extraction volume substantially perpendicular to the axis of ion extraction.

3. The spectrometry system of claim 1, wherein at different times, the ion attracting potential is adjusted to different values so that during said different times, only ions below respective different mobility thresholds contribute to respective mass- and/or mobility spectra.

4. The spectrometry system of claim 1, wherein an ion repelling potential, measured relative to the potential of the passage, is applied to a filter electrode positioned around the extraction volume so that the resultant electric field pushes said ions substantially perpendicular towards the axis of ion extraction and into the extraction volume.

5. The spectrometry system of claim 1, wherein at least one of a purity, a pressure, a temperature, and a humidity of said externally supplied clean buffer gas is controlled, kept constant or varied over time.

6. The spectrometry system of claim 1, wherein said externally supplied clean buffer gas comprises a gas that has desirable properties for said mass-spectrometer and/or said mobility spectrometer, while said ion-source buffer gas comprises a gas that has desirable properties for said at least one ion source.

7. The spectrometry system of claim 1, wherein the mixture of said clean buffer gas replaces the ion-source buffer gas such that the ion-source buffer gas includes phosphates and/or nitrates that are capable of forming deposits on surfaces in said spectrometer.

8. The spectrometry system of claim 1, wherein to the clean buffer gas, a shift reagent is added that reacts chemically with a specific molecule ion so that the resulting ion has a larger mass or a smaller mass or a larger mobility or a smaller mobility than the original molecule ion.

9. The spectrometry system of claim 8, wherein said shift reagent is added intermittently for short periods, so that said molecules of larger masses or of smaller masses or of larger mobilities or of smaller mobilities appear only for short periods in the recorded spectra of said mass spectrometer and/or of said mobility spectrometer.

10. The spectrometry system of claim 1, wherein parts of the main filter or parts of said passage comprise a tube, that transports the ion-source buffer gas of at least one electrospray ion source to the filter, is (a) heated so that the charged droplets from the electrospray ion source are fully evaporated or (b) cooled so that the charged droplets from the electrospray ion source are only partially evaporated before reaching the main volume of the filter, wherein electric fields push the released ions but not said droplets into said extraction volume so that in the recorded mass spectra and/or mobility spectra, the ions which are released at the end of the desolvation process appear in full only in said (a) while in said (b) these ions appear only with reduced intensities, providing additional information on the subject molecules.

11. The spectrometry system of claim 10, wherein a reagent is added to a solvent of at least one electro-spray ion source, wherein said reagent changes the affinity of said subject molecules to the droplet surfaces, and causes ionized ones of said subject molecules to be released at a different time from evaporating charged droplets as compared to when said reagent is not added.

12. The spectrometry system of claim 1, wherein said clean buffer gas is supplied (a) through at least one clean-gas guiding tube having one of a round, elliptical or polygonal cross section with a constant or tapered inner bore, said tube being arranged substantially perpendicular to or inclined with respect to said axis of ion extraction along which ions leave said extraction volume, or (b) through a space between at least two substantially parallel flat or slightly conical shaped clean-gas guiding plates arranged substantially perpendicular to said axis of ion extraction.

13. The spectrometry system of claim 1, wherein said clean buffer gas is supplied (a) through a space between at least two substantially concentric clean-gas guiding tubes having one of a round, elliptical, or polygonal cross section with a constant or tapered inner bore with the axes of said tubes being arranged substantially parallel to or substantially coinciding with the axis of ion extraction or (b) through a space between said passage and one substantially concentric clean-gas guiding tube.

14. The spectrometry system of claim 1, wherein the at least one high-pressure ion source blows said ion-source buffer gas directly or through at least one of a focusing device and of a mobility analyzer into the main volume of the filter, where said main volume of said filter substantially surrounds said extraction volume.

15. The spectrometry system of claim 14, wherein the at least one high-pressure ion source blows said ion-source buffer gas into the main volume of said filter through (a) at least one ion-source buffer-gas guiding tube having one of a circular, elliptical, or polygonal cross section with a constant or tapered inner bore said tube being arranged substantially perpendicular to or inclined with respect to said axis of ion extraction, or (b) a space between at least two substantially parallel flat or slightly conical shaped ion-source buffer gas guiding plates that are arranged substantially perpendicular to said axis of ion extraction.

16. The spectrometry system of claim 1, wherein the at least one high-pressure ion source blows said ion-source buffer gas into the main volume of said filter through (a) at least one ion-source buffer-gas guiding tube having one of a circular, elliptical or polygonal cross section with a constant or tapered inner bore said tube being arranged substantially parallel to said axis of ion extraction, or (b) through a space between at least two ion-source buffer-gas guiding tubes having axes that are substantially parallel or substantially coinciding with said axis of ion extraction.

17. The spectrometry system of claim 16, wherein different constant and/or high-frequency potentials are applied to said at least two ion-source buffer gas guiding tubes, so that an electric field is established substantially perpendicular to the flow of the ion-containing ion-source buffer gas, causing ions having mobilities higher than a threshold mobility to be forced to at least one of said at least two buffer-gas guiding tubes, where said forced ions are discharged and eliminated from said ion-source buffer gas flowing into the main filter volume, and wherein said threshold mobility is controlled by the amplitude of said constant and/or high-frequency potentials.

18. The spectrometry system of claim 17, wherein the waveform of said high-frequency potentials is selected from the group consisting of constant, sinusoidal and rectangular.

19. The spectrometry system of claim 17, wherein said high-frequency potential difference applied to said at least two ion-source buffer-gas guiding tubes is asymmetric such that there is a high field for a shorter time and a low field for a longer time, so that a time integral over the electric field during high-field periods differs from a time integral over the electric field during low-field periods, so that only ions can pass that have high-field mobilities that differ from their low-field mobilities by substantially the same percentage as said time integrals over the corresponding field periods, wherein during certain periods a constant potential difference is added so that during the respective periods ions can pass whose high-field and low-field mobilities have respective different ratios.

20. The spectrometry system of claim 17, wherein the threshold mobility is adjusted to substantially only eliminate ions of high mobility formed from protonated clusters of water and solvent molecules, so that only molecule ions of interest remain in the extraction volume and the total ion current downstream of said curtain gas filter monitors the content of molecule ions in the ion-source buffer gas, thus monitoring the content of molecules in the effluent of a gas- or liquid-chromatograph as a function of time.

21. The spectrometry system of claim 1, wherein at least one plate or at least one grid is positioned substantially perpendicular to the axis of ion extraction and substantially outside of the extraction volume and opposite to said passage, and wherein an ion-repelling potential is applied to said at least one plate or said at least one grid relative to the potential of said passage to generate an electric field that pushes a percentage of the ions in the main filter volume into said extraction volume substantially in a direction parallel to said axis of ion extraction.

22. The spectrometry system of claim 21, wherein said at least one plate or said at least one grid has an umbrella-like shape, so that there is a field component that pushes ions substantially parallel to said axis of ion extraction as well as a field component that pushes ions substantially toward said axis of ion extraction.

23. The spectrometry system of claim 21, wherein said at least one plate is positioned so that the ion-depleted ion-source gas is exhausted either through holes in said at least one plate, or around said at least one plate, or through meshes of said at least one grid.

24. The spectrometry system of claim 1, wherein said curtain gas filter is mounted within a tube that is detachably attached to said passage, such that the filter is a physical prolongation of the passage.

25. The spectrometry system of claim 1, wherein at the entrance to said passage an arrangement of ring electrodes is positioned, said ring electrodes having axes substantially coinciding with the axis of ion extraction and having shapes and potentials such that the potential distribution approximates that of an ion attracting point charge located close to the entrance of said passage situated within said extraction volume from where said ions are sucked into said passage.

26. The spectrometry system of claim 25, wherein said ring electrodes comprise at least one tubular ring electrode with an axis that substantially coincides with the axis of ion extraction and/or at least one flat ring electrode whose plane is substantially perpendicular to and having an axis substantially coinciding with the axis of ion extraction, wherein the flat ring electrode is configured as a printed circuit board.

27. The spectrometry system of claim 26, wherein the entrance to said passage comprises a skimmer having a top that protrudes slightly through said at least one flat ring electrode.

28. The spectrometry system of claim 26, wherein said at least one tubular ring electrode and/or said at least one flat ring electrode is divided in azimuthal sections, to which different potentials are applied to generate multipole-fields including dipole-fields superimposed over said rotationally symmetric electric field.

29. The spectrometry system of claim 1, wherein said passage comprises either only at least one diaphragm or at least one diaphragm mounted upstream and/or downstream of a capillary, and wherein an inner diameter of said at least one diaphragm varies along said axis of ion extraction, so that said inner diameter first decreases and then increases.

30. The spectrometry system of claim 29, wherein said diaphragm comprises insulating material or a material of high-resistivity, and (a) comprises an inner surface coated by a conductive material through which a current is passed which is substantially parallel to said axis of ion extraction or (b) comprises conductive parts through which a current is passed that is substantially parallel to said axis of ion extraction, so that in said (a) and said (b), an electric field is formed that assists the motion of ions through said diaphragm.

31. The spectrometry system of claim 4, wherein said filter electrode positioned around said extraction volume comprises a resistive material through which a current is passed substantially parallel to said axis of ion extraction, so that an electric field is established that pushes ions substantially parallel to said axis of ion extraction towards said passage.

32. The spectrometry system of claim 1, wherein said passage further comprises at least one channel plate, having channels through which ions are forced by gas-flow forces when the channel plate is mounted such that a pressure difference is established across the channel plate between by increasing a gas pressure upstream of said at least one channel plate and/or by reducing a gas pressure downstream of said at least one channel plate, wherein the gas pressure downstream of said at least one channel plate can be several percent of one atmosphere.

33. The spectrometry system of claim 32, wherein a potential difference is applied across the at least one channel plate, to establish electric fields that assist ion motion through said channels.

34. The spectrometry system of claim 1, wherein at least one channel plate is mounted upstream and/or downstream of at least one of said at least one mobility spectrometer, wherein the gas pressure downstream of said at least one channel plate can be several percent of one atmosphere.

35. The spectrometry system of claim 14, wherein a channel plate is mounted upstream or downstream of said at least one focusing device or said at least one mobility analyzer, wherein the gas pressure downstream of said at least one channel plate can be several percent of one atmosphere.

36. The spectrometry system of claim 1, wherein the threshold mobility is adjusted to substantially only eliminate ions of high mobility formed from protonated clusters of water and solvent molecules, so that only molecule ions of interest remain in the extraction volume and the total ion current downstream of said curtain gas filter monitors the content of molecule ions in the ion-source buffer gas, thus monitoring the content of molecules in the effluent of a gas- or liquid-chromatograph as a function of time.

37. The spectrometry system of claim 1, wherein the curtain gas filter is configured such that an ion repelling potential, measured relative to the potential of the passage, is at the other openings in the filter to repel the ions from the other openings in the filter.

* * * * *